United States Patent [19]

Rogers

[11] 4,040,830

[45] Aug. 9, 1977

[54] PHOTOGRAPHIC PRODUCTS COMPRISING EMBOSSED SUPPORTS

[75] Inventor: Howard G. Rogers, Weston, Mass.

[73] Assignee: Polaroid Corporation, Cambridge, Mass.

[21] Appl. No.: 608,062

[22] Filed: Aug. 27, 1975

[51] Int. Cl.[2] ..... G03C 1/72; G03C 1/84; G03C 1/40; G03C 1/76

[52] U.S. Cl. ..... 96/73; 96/3; 96/29 D; 96/74; 96/76 R; 96/77; 96/79; 96/84 R; 96/87 R

[58] Field of Search ..... 96/81, 76 R, 116, 79, 96/26, 40, 29 R, 77, 29 D, 3, 50 PL, 87 R, 73, 84 R; 428/409; 427/162

[56] References Cited

U.S. PATENT DOCUMENTS

| | | | |
|---|---|---|---|
| 2,191,038 | 2/1940 | Capstaff | 96/81 |
| 2,662,822 | 12/1953 | Land | 96/29 R |
| 2,763,551 | 9/1956 | Smith | 96/40 |
| 2,944,894 | 7/1960 | Land | 96/76 R |
| 2,992,103 | 7/1961 | Land et al. | 96/29 D |
| 3,345,176 | 10/1967 | Erikson et al. | 96/79 |
| 3,396,018 | 8/1968 | Beavers et al. | 96/29 R |
| 3,424,584 | 1/1969 | Cook | 96/76 R |
| 3,647,437 | 3/1972 | Land | 96/3 |
| 3,697,277 | 10/1972 | King | 96/50 PL |
| 3,793,022 | 2/1974 | Land et al. | 96/76 R |
| 3,833,368 | 9/1974 | Land et al. | 96/76 R |
| 3,923,513 | 12/1975 | Evans | 96/76 R |

*Primary Examiner*—David Klein
*Assistant Examiner*—Richard L. Schilling
*Attorney, Agent, or Firm*—Stanley H. Mervis

[57] ABSTRACT

Integral negative-positive diffusion transfer reflection prints are provided with a non-planar, e.g., lenticular, surface through which the transfer image is viewed.

36 Claims, 2 Drawing Figures

PHOTOGRAPHIC PRODUCTS COMPRISING EMBOSSED SUPPORTS

Figure 1:
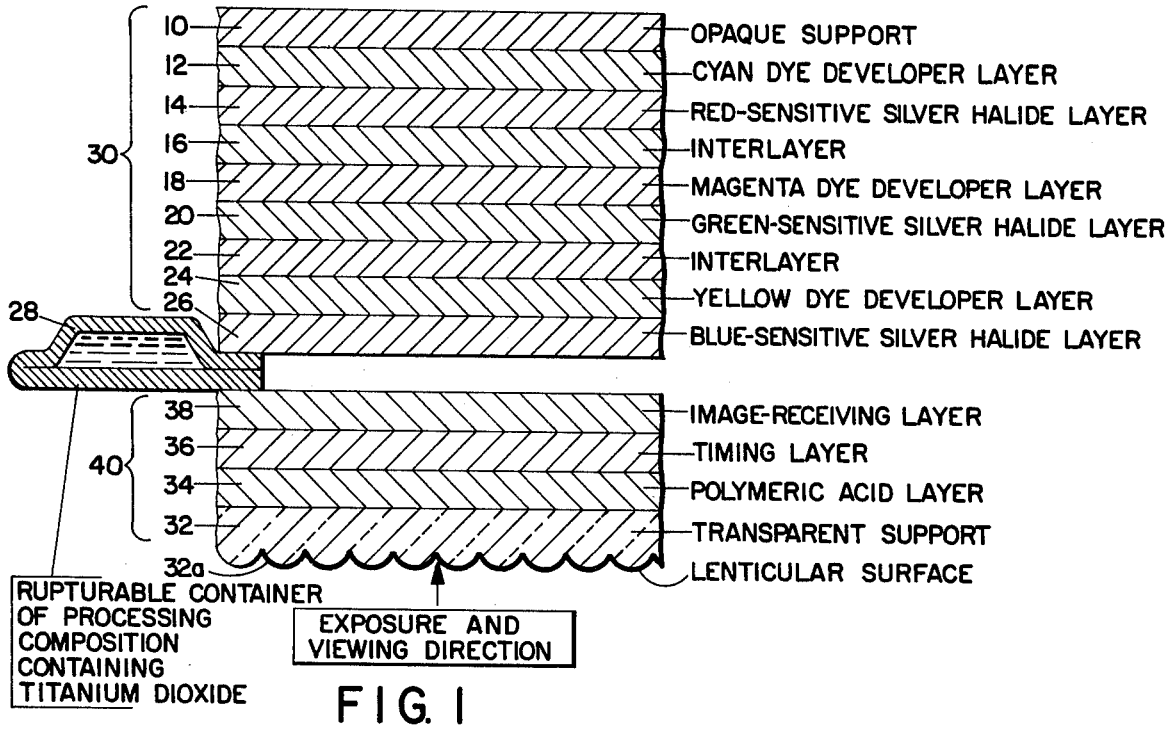

This invention is concerned with photography and, more particularly, with the formation of images in color or black-and-white by diffusion transfer processing.

A number of photographic processes have been proposed wherein the resulting photograph comprises the developed silver halide emulsion(s) retained as part of a permanent laminate, with the desired image being viewed through a transparent support. Of particular significance are those processes where the image is in color and is formed by a diffusion transfer process. If the image is to be viewed as a reflection print, the image-carrying layer is separated from the developed silver halide emulsion(s) in said laminate by a light-reflecting layer, preferably a layer containing titanium dioxide. Illustrative of patents describing such products and processes are U.S. Pat. No. 2.983,606 issued Mar. 9, 1961 to Howard G. Rogers, U.S. Pat. Nos. 3,415,644, 3,415,645 andd 3,415,646 issued Dec. 10, 1968 to Edwin H. Land, U.S. Pat. Nos. 3,594,164 and 3,594,165 issued July 20, 1971 to Howard G. Rogers, and U.S. Pat. No. 3,647,437 issued Mar. 7, 1972 to Edwin H. Land.

Referring more specifically to the aforementioned U.S. Pat. No. 3,415,644, said patent discloses photographic products and processes employing dye developers wherein a photosensitive element and an image-receiving layer are maintained in fixed relationship prior to photoexposure and this fixed relationship is maintained after processing and image formation to provide a laminate including the processed silver halide emulsions and the image-receiving layer. Photoexposure is made through a transparent (support) element and application of a processing composition provides a layer of light-reflecting material to provide a white background for viewing the image and to mask the developed silver halide emulsions. The desired color transfer image is viewed through said transparent support against said white background.

While such processes provide very useful and good quality images, it has been found that the full potential quality of the image is not obtained because the transparent support through which the image is viewed in fact reflects "white" light to the viewer's eyes. Furthermore, this property of reflecting some of the light incident on the surface of the transparent support adversely affects the ability of the film to record a subject when photoexposure is effected through such a transparent support.

U.S. Pat. No. 3,793,022, issued Feb. 19, 1974 to Edwin H. Land, Stanley M. Bloom and Howard G. Rogers, proposes to reduce the above-noted problems by the provision of an anti-reflection coating through which the image is viewed and/or photoexposure is effected.

The present invention is directed toward providing a different solution to the problem of glare reflected from the viewing surface of an integral negative-positive reflection print.

It is, therefore, a primary object of this invention to provide novel photographic products and processes which provide color or black-and-white images as part of a permanent laminate, said laminate exhibiting substantially less surface reflection of incident light.

It is a further object of this invention to provide diffusion transfer images, particularly multicolor transfer images, which are viewed through a transparent element the outer surface of which comprises a non-planar surface.

Yet another object of this invention is to provide diffusion transfer films which are exposed through a transparent support, the outer surface of which comprises a lenticular surface.

Other objects of this invention will in part be obvious and will in part appear hereinafter.

The invention accordingly comprises the product possessing the features, properties and relation of components and the process involving the several steps and the relation and order of one or more of such steps with respect to each of the others which are exemplified in the following detailed disclosure, and the scope of the application of which will be indicated in the claims.

Figure 2:
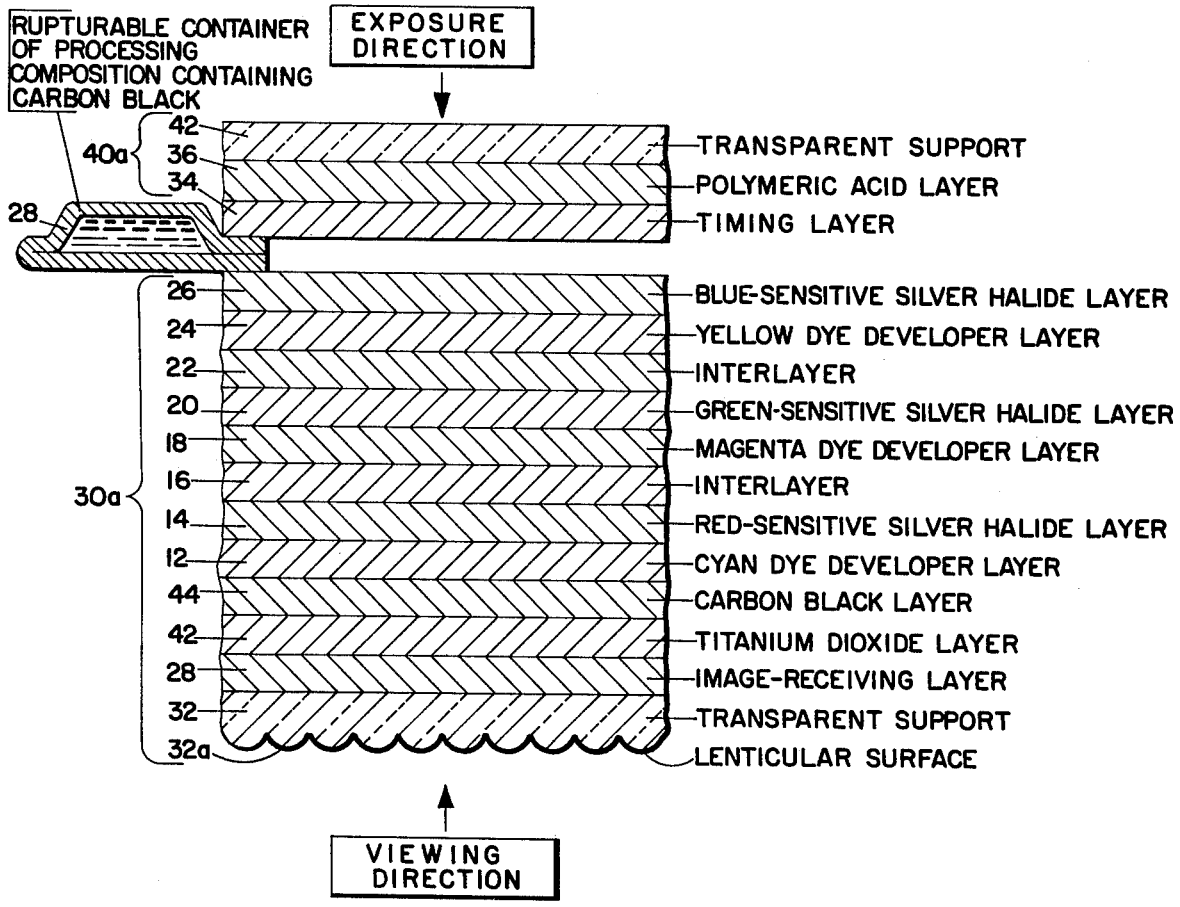

For a fuller understanding of the nature and objects of the invention, reference should be had to the following detailed description of the invention taken in conjunction with the accompanying drawings wherein:

FIGS. 1 and 2 are diagrammatic, enlarged crosssectional views of two embodiments of film units embodying the present invention.

As noted above, this invention is particularly concerned with color diffusion transfer processes wherein the layer containing the diffusion transfer image, i.e., the image-receiving layer, is not separated from the developed photosensitive layers after processing but both components are retained together as part of a permanent laminate. Film units particularly adapted to provide such diffusion transfer images have frequently been referred to as "integral neegative-positive" film units. The resulting image may be referred to as an "integral negative-positive reflection print" and as so used this expression is intended to refer to a reflection print wherein the developed photosensitive layers have not been separated from the image layer, i.e., the layer containing the transfer dye image. A light-reflecting layer between the developed photosensitive layer(s) and the image layer provides a white background for the dye image and masks the developed photosensitive layer(s). These layers are part of a permanent laminate which usually includes dimensionally stable outer or support layers, the transfer dye image being viewable through one of said supports. This invention is particularly concerned with improving the aesthetic qualities of such integral negative-positive reflection prints.

The present invention is applicable to a wide variety of diffusion transfer processes, both dye and silver. The arrangement and order of the individual layers of the film used in such processes may vary in many ways as is known in the art, provided the final photograph is a laminate wherein the desired image is viewed through a transparent support, e.g., an integral negative-positive reflection print as described above. For convenience, however, the more specific descriptions of the invention hereinafter set forth will be by use of dye developer diffusion transfer color processes and of integral negative-positive film units of the type contemplated in the previously mentioned patents, particularly U.S. Pat. Nos. 3,415,644 and 3,594,164. It will be readily apparent from such descriptions that other image-forming reagents may be used, e.g., color couplers, coupling dyes or dyes (couplers) which release a diffusible dye or dye intermediate as a result of coupling or oxidation.

When such integral negative-positive reflection prints are viewed under ordinary lighting conditions, a small but significant amount of light is reflected from the external, planar surface of the transparent support. The effect of this reflection of incident light is to limit the clarity with which the image may be seen except when the viewer's eyes are "just right", i.e., good viewing may be highly directional, in that the print may have to be "tilted" with respect to the viewer's line of vision to avoid obscuring image detail. This problem becomes more acute when several persons try to view the same image, as those not directly in front of the print will experience substantial glare, with the amount of glare increasing as the angle of view becomes more oblique. In addition, the color(s) of a color image may appear less saturated.

If photoexposure is effected through such a planar transparent support, reflection of light from the surface of the transparent support has been found to have several undesirable results. One result is a reduction in the exposure index or "speed" of the film, due to the fact that some of the light which has passed through the camera lens will be reflected before it can reach the photosensitive layer(s) and the thus reflected light will not participate in the recording of the photographed subject matter. Furthermore, such reflected light has a tendency to "bounce" within the camera, and may cause flare and reduced contrast and resolution in the final image. If the photoexposure is effected through the transparent support in a camera which includes an image-reversing mirror in the optical path, light reflected from the surface may cause a "ghost" image of a particularly bright object within the scene to be superposed on another portion of the scene in the resulting photograph. The severity of these problems increases as the index of refraction of such transparent support increases.

In accordance with this invention, the external surface of an integral negative-positive print, through which the diffusion transfer image is viewed, is a non-planar surface, i.e., the surface is covered with an array or pattern of minute projections or protuberances or depressions, preferably rounded and convex or concave, and adapted to transmit substantially all of the light incident thereon while reflecting substantially none of said incident light back to the viewer. As an example of a non-planar surface contemplated for use in the practice of the present invention, mention may be made of a lenticulated or lenticular surface, preferably convex lenticules.

The individual elements providing the non-planar, e.g., lenticular surface, preferably are microscopic in size, i.e., they are so small that a viewer cannot distinguish the individual elements without the aid of a magnification aid. If the surface is a lenticular surface, it may be composed of at least about 150, and preferably at least 250, lenticules per inch. The individual elements may form a pattern which is of regular or irregular, i.e., random, spacing over the area of an individual reflection print; in certain embodiments, a random spacing may be advantageous to minimize diffraction patterns in viewing, particularly where the number of elements is greater than 250 elements per inch. The maximum slope of the individual elements should be selected to assure that a smaller and weaker spot of a point source of light is reflected to the viewer's eye than if it were reflected from a flat surface. The angle formed by the side of the lenticule (or similar element) and the base thereof preferably is less than about 15°, and more preferably is about 10° or less. The individual elements may be of the same size or they may vary in size. If lenticular, the individual lenticules may be cylindrical, spherical, square or hexagonal, as well as convex or concave. The use of a random array is effective to avoid diffraction patterns which may give colored fringes under certain conditions of viewing.

It will be recognized that when the outer surface through which the image is viewed is non-planar, the image itself is in a planar layer.

The desired non-planar surface may be provided by embossing techniques, e.g., such as those used in forming lenticular surfaces, or by casting onto a non-planar surface to replicate the pattern thereof. The non-planar surface may be imparted to the transparent polymeric film base itself or to a thin, optically clear coating carried thereon, e.g., to a layer of cellulose acetate butyrate coated on polyethylene terephthalate. Where the non-planar layer is of a different polymer it is advantageously a polymer having an index of refraction lower than that of the polymeric film base.

While the non-planar surface will normally be in optical contact with air, it is within the scope of this invention to apply an anti-reflection coating over the nonplanar surface to further reduce reflection. Suitable anti-reflection coatings are described in the above-mentioned U.S. Pat. No. 3,793,022, and may comprise an inorganic or organic low index of refraction material as set forth in detail in said patent. If the anti-reflection coating is one which is to be applied from a solvent, care should be exercised that the coating solvent is not one which will soften or otherwise attack the polymer forming the non-planar surface lest it be deformed and the desired optical properties thereof be adversely affected.

It has been found that the non-planar surface is effective as an anti-abrasion or scratch-resistant surface. It has also been found that a non-planar surface, such as the lenticular surface in the example set forth below, does not readily show fingerprints.

Transparent supports which may be provided with non-planar surfaces in accordance with this invention include polyesters, polystyrene, cellulose esters (such as cellulose acetate [triacetate] and cellulose acetate butyrate) polycarbonates, and similar art known polymeric film base materials. Such film bases typically have a thickness of about 3 to 10 mils (0.003 to 0.010). Particularly useful polyester film bases have a thickness of about 3 to 6 mils. Particularly useful transparent supports are films of polyethylene terephthalate, such as those commercially available under the trademarks Mylar (E. I. du Pont de Nemours & Co.) and Estar (Eastman Kodak Co.).

Reference is now made to the accompanying drawings wherein a plurality of embodiments of this invention are illustrated and wherein like numbers, appearing in the various figures, refer to like components. The illustrated embodiments include appropriate means of opacification to permit the processing of the film unit outside of a dark chamber, i.e., the film unit is intended to be removed from the camera prior to image completion and while the film is still photosensitive. Opacifying systems are described in the previously noted patents and per se form no part of the present invention which is equally applicable to film units intended to be processed within a dark chamber.

[A particularly useful opacifying system for film units of the type shown in FIG. 1 utilizes a color dischargeable reagent, preferably a pH-sensitive optical filter agent or dye, sometimes referred to as an indicator dye, as is described in detail in the aforementioned U.S. Pat.

No. 3,647,437. In film units of the type shown in FIG. 2, photoexposure is effected from the side opposite the side from which the image is viewed. An opaque layer to protect the exposed silver halide from further exposure may be provided by including a light-absorbing opacitying agent, e.g., carbon black, in the processing composition which is distributed between the photosensitive layer(s) and a transparent support or spreader sheet. In such film units, it may be desirable to include a preformed opaque layer, e.g., a dispersion of carbon black in a polymer permeable to the processing composition, between a preformed light-reflecting layer and the silver halide emulsion(s). Such opacifying systems are shown and described in the aforementioned U.S. Pat. Nos. 3,594,164 and 3,594,165.]

Referring to FIG. 1, there is shown a photosensitive element 30 in superposed relationship with an image-receiving element 40, with a rupturable container 28 (holding an opaque processing composition) so positioned as to discharge its contents between said elements upon suitable application of pressure, as by passing through a pair of pressure applying rolls or other pressure means (not shown). Photosensitive element 30 comprises an opaque support 10 carrying, in sequence, a layer 12 of a cyan dye developer, a red-sensitive silver halide emulsion layer 14, an interlayer 14, a layer 16 of a magneta dye developer, a green-sensitive silver halide emulsion layer 18, an interlayer 20, a layer 24 of a yellow dye developer, and a blue-sensitive silver halide emulsion layer 26. An auxiliary layer, not shown, may be provided as an anti-abrasion coating and may also carry a reagent, e.g., an auxiliary developing agent. The image-receiving element 40 comprises a transparent support 32 carrying, in turn, a polymeric acid layer 34, a spacer layer 36 and an imagereceiving layer 38. The outer surface 32*a* of the transparent support 32 is non-planar, e.g., lenticulated. Photoexposure of the silver halide emulsion layer is effected through the non-planar surface 32*a* and the transparent support 32 and the layers carried thereon, i.e., the polymeric acid layer 34, the space layer 36 and the image-receiving layer 38 which layers are also transparent, the film unit being so positioned within the camera that light admitted through the camera exposure or lens system is incident upon the outer non-planar surface 32*a*. After exposure the film unit is advanced between suitable pressure-applying members, rupturing the container 28, thereby releasing and distributing a layer of the opaque processing composition between the photosensitive element 30 and the image-receiving element 40. The opaque processing composition contains a film-forming polymer, a white pigment and has an initial pH at which one or more optical filter agents contained are colored; the optical filter agent (agents) in (are) selected to exhibit light absorption over the wavelength range of light actinic to the silver halide emulsion. As a result, ambient or environmental light within that wavelength range which, after removal of the film unit from a camera, is incident upon transparent support 32 and therefore transmitted through said transparent support and the transparent layers carried thereon in the direction of the photoexposed silver halide emulsions is absorbed thereby avoiding further exposure of the photoexposed and developing silver halide emulsions. In exposed and developed areas, the dye developer is oxidized as a function of the silver halide development and immobilized. Unoxidized dye developer associated with undeveloped and partially developed areas remains mobile and is transferred imagewise to the imagereceiving layer 38 to provide the desired positive image therein. Permeation of the alkaline processing composition through the image-receiving layer 38 and the spacer layer 36 to the polymeric acid layer 34 is to controlled that the process pH is maintained at a high enough level to effect the requisite development and image transfer and to retain the optical filter agent (agents) in colored form, after which pH reduction effected as a result of alkali permeation into the polymeric acid layer 36 is effective to reduce the pH to a level which "discharges" the optical filter agent, i.e., changes it to a colorless form. Absorption of the water from the applied layer of the processing composition results in a solidified film composed of the film-forming polymer and the white pigment dispersed therein, thus providing a lightreflecting layer which also serves to laminate together the photosensitive element 30 and the image-receiving element 40 to provide the final laminate. The positive transfer image in dye developer present in the image-receiving layer 38 is viewed through the transparent support 32 and the intermediate transparent layers against the light-reflecting layer which provides an essentially white background for the dye image and also effectively masks from view the developed silver halide emulsion layers 14, 20 and 26 and dye developers immobilized therein or remaining in the dye developer layers 12, 18 and 24.

The optical filter agent is retained within the final film unit laminate and is preferably colorless in its final form, i.e., exhibiting no visible absorption to degrade the transfer image or the white background therefor provided by the reflecting layer 17*b*. The optical filter agent may be retained in the reflecting layer under these conditions, and it may contain a suitable "anchor" or "ballast" group to prevent its diffusion into adjacent layers. Additionally, if the optical filter agent is initially diffusible, it may be selectively immobilized on the silver halide emulsion side of the light-reflecting layer, e.g., by a mordant coated on the surface of the silver halide emulsion layer 26; in this embodiment the optical filter in its final state may be colorless or colored so long as any color exhibited by it is effectively masked by the light-reflecting layer.

The reflecting layer provided in the embodiment of this invention shown in FIG. 1 is formed by solidification of a stratum of pigmented processing composition distributed after exposure. It is also within the scope of this invention to provide a preformed pigmented layer, e.g., coated over the image-receiving layer 38, and to effect photoexposure therethrough, in accordance with the teachings of U.S. Pat. No. 3,615,421 issued Oct. 26, 1971 to Edwin H. Land.

In the embodiment illustrated in FIG. 1, photoexposure is effected through the image-receiving element. While this is a particularly useful and preferred embodiment, it will be understood that the image-receiving element may be initially positioned out of the exposure path and superposed upon the photosensitive element after photoexposure.

In the embodiment illustrated in FIG. 1, photoexposure and viewing of the final image both are effected through the transparent support 32 and non-planar surface 32*a*. Accordingly, the advantages of the anti-reflection non-planar surface are obtained twice, i.e., first, by minimizing failure of the film unit to record light passed by the camera lens and second, by minimizing glare during viewing.

It is also contemplated that, e.g., in the embodiment illustrated in FIG. 1 the image-viewing layer 38 is temporarily bonded to the silver halide emulsion layer 26 (or to an auxiliary layer if present) prior to exposure. The rupturable container or pod 28 is so positioned that upon its rupture the processing composition will delaminate the film unit and distribute itself between the temporarily laminated layers. The distributed layer of processing composition upon solidification forms a layer which bonds the elements together to form the desired permanent laminate. Procedures for forming such prelaminated film units, i.e., film units in which the several elements are temporarily laminated together prior to exposure, are described, for example, in U.S. Pat. No. 3,625,281 issued to Albert J. Bachelder and Frederick J. Binda and in U.S. Pat. No. 3,652,282 to Edwin H. Land, both issued Mar. 28, 1972. A particularly useful and preferred prelamination utilizes a water-soluble polyethylene glycol as described and claimed in U.S. Pat. No. 3,793,022 issued Feb. 19, 1974 to Edwin H. Land.

The use of such temporarily laminated film units maximizes the beneficial effects obtained in the photoexposure stage from having the exposure effected through the non-planar surface 32*a*, since the prelamination eliminates any other layer-to-air interface which could also reflect light and thus reduce the amount of light recorded by the photosensitive layer(s). If such a temporary lamination is employed, it may be advantageous to provide a flare-reducing layer, e.g., a layer of carbon black in gelatin, over the blue-sensitive silver halide emulsion, as described and claimed in the copending application of Stanley M. Bloom and Howard G. Rogers, Ser. No. 554,741 filed Mar. 3, 1975.

It will be recognized that the transfer image formed following exposure and processing of film units of the type illustrated in FIG. 1 will be a geometrically reversed image of the subject. Accordingly, to provide geometrically nonreversed transfer images, exposure of such film units should be accomplished through an image reversing optical system, such as in a camera possessing an image reversing optical system utilizing mirror optics, e.g., as described in U.S. Pat. No. 3,447,437 issued June 3, 1969 to Douglas B. Tiffany. As noted above, when photoexposure is effected in such an image reversing optical system, photoexposure through a non-planar surface provides additional advantages in preventing or at least minimizing the reflection of light from the film surface back to the mirror and back to the film unit and which might thus cause the formation in the final image of a reflected or "ghost" image of a very bright part of the photographed scene superposed upon another part of the scene.

If desired, the photosensitive element 30 may utilize a transparent support instead of the opaque support 10 shown in FIG. 1. In this alternative embodiment, the film unit should be processed in a dark chamber or an opaque layer, e.g., pressure-sensitive, should be superposed over said transparent support to avoid further exposure through the back of the film unit during processing outside of the camera.

FIG. 2 illustrates another film structure adapted to provide an integral negative-positive reflection print and wherein photoexposure and viewing are effected from opposite sides. In this embodiment an integral image-receiving/photosensitive element 30*a* comprises a transparent support 32 having a non-planar outer surface 32*a* and carrying, in sequence, an image-receiving layer 28, a white, light-reflecting layer of titanium dioxide, an opaque layer 44 containing carbon black, a cyan dye developer layer 12, a red-sensitive silver halide emulsion layer 14, an interlayer 16, a magenta dye developer layer 18, a green-sensitive silver halide emulsion layer 20, an interlayer 22, a yellow dye developer layer 24 and a blue-sensitive silver halide emulsion layer 26. As in FIG. 1, an auxiliary layer may be coated over the bluesensitive silver halide emulsion layer. A spreader or cover sheet 40*a* comprises a transparent support 42 carrying, in sequence, a polymeric acid layer 36 and a timing layer 34. After photoexposure, a processing composition is applied by rupturing a pod 28 and distributing the processing composition between the cover or spreader sheet 40*a* and the outermost layer of the photoexposed element 30*a*. The spreader sheet 40*a* may be transparent as illustrated in FIG. 2 and described in detail in the above-noted U.S. Pat. No. 3,594,165, in which event photoexposure may be effected through it while it is held in place, e.g., by a binder tape around the edges of the film unit or by temporary lamination prior to photoexposure, as discussed above. In this embodiment, a non-planar surface, not shown, may be provided on the outer or exposure surface of the transparent spreader sheet support 42. (Alternatively, the spreader sheet support 42 may be opaque in which event it is positioned out of the exposure path prior to photoexposure, as described in detail in the above-noted U.S. Pat. No. 3,594,164.) The processing composition contains suitable opacifying agents, e.g., carbon black, titanium dioxide, etc. The light-reflecting layer 42 preferably includes a white pigment, such as titanium dioxide, to provide a white background against which the transfer image may be viewed. The opaque layer 44, e.g., a layer of carbon black in gelatin, provides the requisite light protection while assuring an aesthetically pleasing white background for the final image.

Processing of film units of the types described above is initiated by distributing the processing composition between predetermined layers of the film unit. In exposed and developed areas, the dye developer will be immobilized as a function of development. In unexposed and undeveloped areas, the dye developer is unreacted and diffusible, and this provides an imagewise distribution of unoxidized dye developer, diffusible in the processing composition, as a function of the point-to-point degree of exposure of the silver halide layer. The desired transfer image is obtained by the diffusion transfer to the image-receiving layer of at least part of this imagewise distribution of unoxidized dye developer. In the illustrated embodiments, the pH of the photographic system is controlled and reduced by the neutralization of alkali after a predetermined interval, in accordance with the teachings of the above-noted U.S. Pat. Nos. 3,615,644 and 3,594,165, to reduce the alkalinity to a pH at which the unoxidized dye developer is substantially insoluble and non-diffusible. As will be readily recognized, the details of such processes form no part of the present invention but are well known; the previously noted U.S. patents may be referred to for more specific discussion of such processes.

As will be understood by those skilled in the art, multicolor images may be obtained by providing the requisite number of differentially exposable silver halide emulsions, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tripack" structure and contain blue-, green-, and red-sensitive silver halide layers each having associated therewith in the same or in a contiguous layer a yellow, a magenta and a cyan image dye-providing material respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 issued Oct. 3, 1967 to Edwin H. Land and Howard G. Rogers as well as in the previously noted U. S. patents, e.g., in FIG. 9 of the aforementioned U.S. Pat. No. 2,983,606.

A number of modifications to the structures described in connection with the FIGS. will readily suggest themselves to one skilled in the art. Thus, for example, the multicolor multilayer negative may be replaced by a screentype negative as illustrated in U.S. Pat. No. 2,968,554 issued Jan. 17, 1961 to Edwin H. Land and in the aforementioned U.S. Pat. No. 2,983,606 particularly with respect to FIG. 3 thereof.

The image dye-providing materials which may be employed in such processes generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise pattern as a function of development. These materials may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer, mention may be made of those disclosed, for example, in U.S. Pat. Nos. 2,744,668; 2,968,554; 2,983,606; 2,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; and 3,227,552. Both types of image dye-providing substances and film units useful therewith also are discussed in the aforementioned U.S. pat. No. 3,647,437 to which reference may be made.

It will be understood that dye transfer images which are neutral or black-and-white instead of monochrome or multicolor may be obtained by use of a single dye or a mixture of dyes of the appropriate color in proper proportions, the transfer of which may be controlled by a single layer of silver halide, in accordance with known techniques. It is also to be understood that "direct positive" silver halide emulsions may also be used, depending upon the particular image dye-providing substances employed and whether a positive or negative color transfer image is desired.

It will also be understood that the present invention may be utilized with films wherein the final image is in silver, the photoexposure and/or viewing is effected through a transparent support which is provided with a non-planar surface in accordance with the teachings of this invention. The transfer of silver (employing known silver transfer techniques including silver halide solvents and silver precipitating agents) may be utilized to provide a positive silver transfer image or to provide a dye image by silver dye bleach processing.

In the preferred embodiments, the layers comprising the individual film units are secured in fixed relationship prior to, during, and after photoexposure and processing to provide the desired integral negative-positive image. Film units of this type are well known in the art and are illustrated, for example, in the above cited U.S. Pat. Nos. 3,415,644; 3,647,437; and 3,594,165, as well as in other patents. In general, a binding member is provided extending around, for example, the edges of the composite structure and securing the elements thereof in fixed relationship. The binding member may comprise a presssure-sensitive tape securing and/or maintaining the layers of the structure together at its respective edges. If the edge tapes are also opaque, edge leakage of actinic radiation incident on the film unit will be prevented. The edge tapes also will act to prevent leakage of the processing composition from the laminate during and after processing. The rupturable container or pod is so positioned as to effect unidirectional discharge of its contents between predetermined layers; e.g., between the image-receiving layer 38 and the blue-sensitive silver halide emulsion layer 26 of FIG. 1 upon application of compressive force to the pod; these layers may be temporarily bonded to each other with a bond strength less than that exhibited by the interface between the opposed surfaces of the remaining layers, as described above. The binding member may also serve to provide a white mask or border for the final image. The manufacture of such film units or packets is well described in the above-noted and other patents and need not be set forth in any detail herein.

Rupturable container 28 may be of the type shown and described in any of U.S. Pat. Nos. 2,543,181; 2,634,886; 3,653,732; 2,723,051; 3,056,492; 3,056,491; 3,152,515; and the like. In general, such containers will comprise a rectangular blank of fluid- and air-impervious sheet material folded longitudinally upon itself to form two walls which are sealed to one another along their longitudinal and end margins to form a cavity in which the processing composition is retained. The longitudinal marginal seal is made weaker than the end seals so as to become unsealed in response to the hydraulic pressure generated within the fluid contents of the container by the application of compressive pressure to the walls of the container, e.g., by passing the film unit between opposed pressure applying rollers.

Thus, the rupturable container 28, as illustrated in FIGS. 1 and 2, is fixedly positioned and extends transverse a leading edge of the film unit with its weaker, longitudinal marginal seal directed toward the interface between the predetermined layers between which the processing composition is to be distributed. The rupturable container 28 is fixedly secured, e.g., by a tape extending over a portion of one wall of the container, in combination with a separate retaining member or tape extending over a portion of the film unit's surface generally equal in area to about that covered by said tape.

As noted above, a preferred opacification system to be contained in the processing composition employed in the embodiment shown in FIG. 1 to effect processing outside of a camera is that described in the above-mentioned U.S. Pat. No. 3,647,4317, and comprises a dispersion of an inorganic light-reflecting pigment which also contains at least one light-absorbing agent, i.e., optical filter agent, at a pH above the pKa of the optical filter agent in a concentration effective when the processing composition is applied, to provide a layer exhibiting optical transmission density > than about 6.0 density units with respect to incident radiation actinic to the photosensitive silver halide and optical reflection density < than about 1.0 density units with respect to incident visible radiation.

In lieu of having the light-reflecting pigment in the processing composition, the light-reflecting pigment used to mask the photosensitive strata and to provide the background for viewing the color transfer image formed in the receiving layer may be present initially in whole or in part as a preformed layer in the film unit. As an example of such a preformed layer, mention may be made of that disclosed in U.S. Pat. No. 3,615,421 issued Oct. 26, 1971 and in U.S. Patent No. 3,620,724 issued Nov. 16, 1971, both in the name of Edwin H. Land. The reflecting agent may be generated in situ as is disclosed in U.S. Pat. Nos. 3,647,434 and 3,647,435, both issued Mar. 7, 1971 to Edwin H. Land.

The dye developers (or other image dye-providing substances) are preferably selected for their ability to provide colors that are useful in carrying out subtractive color photography, that is, the previously mentioned cyan, magenta and yellow. They may be incorporated in the respective silver halide emulsion or, in the preferred embodiment, in a separate layer behind the respective silver halide emulsion. Thus a dye developer may, for example, be in a coating or layer behind the respective silver halide emulsion and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

Dye developers, as noted above, are compounds which contain the chromophoric system of a dye and also a silver halide developing function. By "a silver halide developing function" is meant a group adapted to develop exposed silver halide. A preferred silver halide development function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms quinonoid or quinone substances when oxidized.

The image-receiving layer may comprise one of the materials known in the art, such as polyvinyl alcohol, gelatin, etc. It may contain agents adapted to mordant or otherwise fix the transferred images dye(s). Particularly useful image-receiving layers comprise polyvinyl alcohol or gelatin containing a dye mordant such as poly-4-vinylpyridine, as disclosed in U.S. Pat. No. 3,148,061, issued Sept. 8, 1964 to Howard C. Haas.

In various color diffusion transfer systems which have previously been described, and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. Nos. 3,415,644 and 3,594,165 disclose systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali metals or with organic bases; or potentially acid-yielding groups such as anhydrides or lactones. Preferably the acid polymer contains free carboxyl groups. Another system for providing an acid-reacting reagent is disclosed in U.S. Pat. No. 3,576,625 issued Apr. 27, 1971 to Edwin H. Land.

An inert interlayer or spacer layer may be and is preferably disposed between the polymeric acid layer and the dyeable stratum in order to control the "time" the pH reduction so that it is not premature and thus interface with the development process. Suitable spacer or "timing" for this purpose are described with particularity in U.S. Pat. Nos. 3,362,819; 3,419,389; 3,421,893; 3,455,686; and 3,575,701.

While the acid layer and associated spacer layer are preferably contained in the positive component employed in systems wherein the dyeable stratum and photosensitive strata are contained on separate supports, e.g., between the support for the receiving element and the dyeable stratum; or associated with the dyeable stratum in those integral film units, e.g., on the side of the dyeable stratum opposed from the negative components, alternatively or in addition they may be associated with the photosensitive strata, as is disclosed, for example, in U.S. Pat. Nos. 3,362,821 and 3,573,043, i.e., in a layer between the support and the redsensitive silver halide emulsion and cyan image dye-providing material. In film units such as those described in the aforementioned U.S. Pat. Nos. 3,594,164 and 3,594,165, they are advantageously provided on the spreader sheet employed to facilitate application of the processing fluid.

As is now well known and illustrated, for example, in the previously cited patents, the liquid processing composition referred to for effecting multicolor diffusion transfer processes comprises at least an aqueous solution of an alkaline material, for example sodium hydroxide, potassium hydroxide, and the like, and preferably possessing a pH in excess of 12, and more preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution such as, for example, a hydroxyethyl cellulose or sodium carboxymethyl cellulose. Additionally, other film-forming materials or thickening agents whose ability to increase viscosity is substantially unaffected if left in solution for a long period of time are capable of utilization. The film-forming material is preferably contained in the processing composition in such suitable quantities as to impart to the composition a viscosity in excess of 100 cps, at a temperature of approximately 24° C. and preferably in the order of 100,000 cps to 200,000 cps at that temperature.

In particularly useful embodiments of this invention, the transparent supports 32 and 42 contain a small quantity of a pigment, e.g., carbon black, to prevent fog formation due to light-piping by internal reflection within the transparent support of actinic light incident upon the surface thereof as the film unit is ejectd from a camera; such elements are described and claimed in the copending application of Edwin H. Land Ser. No. 419,808 filed Nov. 28, 1973 as a continuation-in-part of Ser. No. 194,407 filed Nov. 1, 1971 (now abandoned). The transparent support advantageously may include an ultraviolet light absorber, as taught in the copending application of Ronald F. Cieciuch and Herbert N. Schlein, Ser. No. 300,277 filed Oct. 24, 1972 (now U.S. Pat. No. 3,923,519 issued Dec. 2, 1975 ), a continuation-in-part of Ser. No. 214,600 filed Jan. 3, 1972 (now abandoned).

The following Example is given to illustrate the present invention, and it will be understood that this invention is not limited to the specific details set forth therein.

EXAMPLE

An integral negative-positive film unit of the type commercially available as Polaroid SX-70 Land film and having a configuration of the type described, e.g., in U.S. Pat. No. 3,415,644 issued Dec. 8, 1968 to Edwin H. Land, was prepared using a lenticulated film base as the support for the image-receiving and other layers forming the positive component. The lenticulated film base was prepared by coating a polyethylene terephthalate film base (approximately 75 microns in thickness ) with a layer of cellulose butyrate (approximately 14 microns in thickness). The cellulose acetate butyrate layer was then embossed to provide continuous, parallel rows of minute cylindrical lenticules. The individual lenticules had a planoconvex configuration sinusoidal in cross section, with a maximum angle of about 14° to the film plane, and a focal length such that light incident thereon was focused at or near the opposite (uncoated) surface of the polyethylene terephthalate film base. The positive image component layers were coated on the uncoated polyethylene terephthalate surface. The positive component thus prepared was superposed on a photosensitive multicolor dye developer negative, with the lenticulated surface outermost, and the two elements taped together with a rupturable container of processing composition positioned to distribute the processing composition between the superposed elements, in a configuration generally similar to that shown in FIG. 1. Photoexposure of the multicolor negative was effected through the positive component in a Polaroid Land SX-70 camera, and the processing composition distributed, in the usual manner, to effect development and formation of a multicolor, diffusion transfer, integral negative-positive reflection print viewable through the lenticular surface. The resulting print had a very low reflection surface, and was highly resistant to fingerprinting and scratching. Film units of this type were also found to be less subject to the formation of ghost images of very bright objects in the scene due to light being re-reflected by the mirror in the exposure path; if formed, such ghost images were found to be weaker than those formed with a planar polyethylene terephthalate support and closer to the image of the object.

In the above example, the lenticular surface constituted a separate layer carried by the film base. It will be understood that the lenticular surface may be provided by directly embossing a film base itself instead of embossing a layer carried by the film base.

Lenticular surfaces are per se well known in the photographic art, and may be prepared by contacting the desired film base (or coated film base) with a rotating embossing roller under appropriate conditions of temperature, pressure and/or solvent to provide lenticules of the desired shape and size.

As noted above, the non-planar surface may also carry an anti-reflection coating or stratum of a material having a low index of refraction. The optimum index of refraction to be exhibited by the anti-reflection coating may be readily calculated by the principles of physics discussed in the above-noted U.S. Pat. No. 3,793,022, but it is not essential that such optimum value be used in order to obtain very beneficial results. The anti-reflection coating preferably has an index of refraction at least 0.20 less than, and more preferably at least 0.20 to 0.3 less than, the index of refraction of the transparent support; the preferred anti-reflection coatings will exhibit an index of refraction of about 1.3 to 1.45.

The transparent support advantageously has a moisture permeability rate adapted to accelerate "drying" of the layers forming the integral negative-positive reflection prints of the preferred embodiments. Reference may be made to U.S. Pat. No. 3,573,044 issued Mar. 30, 1971 to Edwin H. Land for a detailed description of dimensionally stable, transparent supports, e.g., microporous polyesters, having suitable permeability rates, and said description is hereby incorporated herein for convenience. It will be understood that provision of a non-planar surface should not adversely affect the desired moisture transmission rate of the transparent support(s).

While the image dye-providing material is generally carried on the same support as the photosensitive silver halide, it will be understood that this initial location is not essential, as in forming monochromes the image dye-providing material may initially be contained in the processing composition or in a layer of the image-receiving element as is taught, for example, in the use of dye developers in the previously mentioned U.S. Pat. No. 2,983,606.

The provision of the non-planar surface provides a number of advantages. In the absence of the non-planar surface provided in accordance with this invention, the optimum angle for viewing an image through the transparent support is very specific and limited, if the viewer is to avoid to the maximum possible extent seeing specular reflection from the surface of the transparent support of light from the illumination source. The non-planar surface has been found to substantially reduce or prevent such specular reflection, thus greatly improving viewing. The reduction in surface relfection (glare) simplifies copying integral negative-positive reflection prints of the type with which this invention is primarily concerned and aids in obtaining truer copy prints; light polarizers are customarily used to eliminate surface glare during copying. The non-planar surface may also provide anti-abrasion and anti-fingerprint protection and, depending upon the polymer or other material used, desirable anti-friction properties to facilitate transport during manufacture and/or processing.

It is recognized that matte surfaces, such as those commonly referred to as "silk finish", have previously been used in conventional wet-processed prints to reduce glare. Such matte anti-reflection layers function by different principles, e.g., light-scattering, and are totally different in visual appearance and effect from the tuberculated surfaces on the present invention. Thus, for example, while a matte surface reduces glare it also reduces the visual color saturation of the image, and its presence is visually apparent. In contrast, the non-planar surface of the present invention is almost, if not completely, invisible, and it thus permits the color saturation of the image to be seen without the dilution introduced by either a glossy surface or a matte surface.

U.S. Pat. No. 2,950,644 issued Aug. 30, 1960 to Edwin H. Land et al is directed to so-called "cineslides" wherein a plurality of cinematographic images are recorded side-by-side by exposure through a lenticular surface and formed on a transparent layer in registration therewith. Where projected through suitable equipment as described therein, a cinematographic sequence is projected. The lenticules employed in that process are much larger than those used herein, and there is no disclosure or suggestion of utilizing a lenticulated surface to provide an anti-reflection surface for reflection prints.

Where the expression "positive image " has been used, this expression should not be interpreted in a restrictive sense since it is used primarily for purposes of illustration in that it defines the image produced on the image-carrying layer as being reversed, in the positive-negative sense, with respect to the image in the photosensitive emulsion layers. As an example of an alternative meaning for "positive image", assume that the photosensitive element is exposed to actinic light through a negative transparency. In this case, the latent image in the photosensitive emulsion layers will be a positive and the dye image produced on the image-carrying layer will be a negative. The expression "positive image" is intended to cover such an image produced on the image-carrying layer.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. A photographic product comprising a first support carrying a red-sensitive silver halide emulsion; a green-sensitive silver halide emulsion, and a blue-sensitive silver halide emulsion; said silver halide emulsions having associated therewith, respectively, a cyan image dye-providing substance, a magenta image dye-providing substance and a yellow image dye-providing substance, each said image dye-providing substance being selected from the group consisting of image dyes and image-dye intermediates; an image-receiving layer for receiving image dyes transferred thereto by diffusion as a function of exposure and development of said silver halide emulsion layers; said image-receiving layer being carried by one of said first support and a second support; at least said support carrying said image-receiving layer being transparent, said image-receiving layer being viewable through said transparent support; a rupturable container releasable holding a processing composition adapted, upon distribution between predetermined layers of said product to develop said silver halide emulsions and to effect the formation of a multicolor transfer image in dye in said image-receiving layer, said processing composition also being adapted to provide a permanent laminate including said developed silver halide emulsions and said image-receiving layer; and means providing a light-reflecting layer between said image-receiving layer and said silver halide emulsions to provide a white background for viewing said multicolor transfer image and for masking said developed silver halide emulsions; the outer surface of said transparent support being a non-planar, embossed surface.

2. An image-receiving element as defined in claim 1 including a layer of an acid-reacting reagent positioned between said transparent support and said image-receiving layer.

3. A photographic product as defined in claim 1 wherein said image dye-providing material is a compound which provides a diffusible dye as a function of oxidation or color coupling.

4. A photographic product as defined in claim 1 wherein said transparent support is a polyester.

5. A photographic product as defined in claim 4 wherein said polyester is polyethylene terephthalate.

6. A photographic product as defined in claim 1 wherein both of said first and second supports are transparent and the external surface of each said transparent support is a non-planar, embossed surface.

7. A photographic film as defined in claim 1 wherein each said image dye-providing substance is a dye.

8. A photographic film as defined in claim 1 wherein each of said dye is a dye developer.

9. A photographic film as defined in claim 1 wherein each said image dye-providing substance is an intermediate for an image dye.

10. A photographic product as defined in claim 1 wherein said silver halide emulsions are adapted to be exposed through said transparent support.

11. A photographic product as defined in claim 1 wherein said second support is transparent, said silver halide emulsions being adapted to be exposed through said second transparent support.

12. A photographic product as defined in claim 11 wherein the outer surface of said second transparent support also is a non-planar, embossed surface.

13. A photographic product as defined in claim 1 wherein said means providing a light-reflecting layer comprise a white pigment dispersed in said processing composition, and said processing composition is contained in a rupturable container positioned to distribute said processing composition containing said pigment between said image-receiving layer and said silver halide emulsion(s).

14. A photographic product as defined in claim 5 comprising a temporary laminate including said layers confined between said first and said second supports, the bond between a predetermined pair of layers being weaker than the bond between other pairs of layers, and including a rupturable container releasably holding said processing composition, said rupturable container being so positioned as to distribute said processing composition between said predetermined layers, said processing composition being adapted to provide said permanent laminate following distribution and drying.

15. A photographic product as defined in claim 1 wherein said transparent support comprises a polyethylene terephthalate film base carrying on the outer surface a lenticulated cellulose acetate stratum.

16. A photographic product comprising a first support; a red-sensitive silver halide emulsion; a green-sensitive silver halide emulsion, and a blue-sensitive silver halide emulsion; said silver halide emulsions having associated therewith, respectively, a cyan dye developer, a magenta dye developer and a yellow dye developer; an image-receiving layer for receiving image dyes transferred thereto by diffusion as a function of exposure and development of said silver halide emulsion layers; a second support which is transparent and through which said image-receiving layer may be viewed, a rupturable container releasable holding a processing composition adapted, upon distribution between predetermined layers of said product to develop said silver halide emulsions and to effect the formation of a transfer image in dye in said image-receiving layer, said processing composition also being adapted to provide a permanent laminate including said developed silver halide emulsions and said image-receiving layer; and means providing a light-reflecting layer between said image-receiving layer and said silver halide emulsions effective to provide a white background for viewing said transfer image and for masking said developed silver halide emulsions; the outer surface of said transparent support being a non-planar, lenticulated surface.

17. A photographic product as defined in claim 16 wherein said means for providing a light-reflecting layer comprises a white pigment dispersed in said processing composition.

18. A photographic product as defined in claim 16 wherein said first support is opaque.

19. A photographic product as defined in claim 16 wherein said transparent support is a polyester.

20. A photographic product as defined in claim 16 wherein said transparent support is cellulose acetate.

21. A photographic product as defined in claim 16 wherein said transparent support and said image-receiving layer comprise a separate element adapted to be brought into superposed relationship with said silver halide emulsions.

22. A photographic product as defined in claim 16 wherein said layers are held in fixed relationship between said supports prior to and during exposure.

23. A photographic product as defined in claim 22 wherein said fixed relationship is provided by binder means along at least two parallel sides of said product.

24. A photographic product as defined in claim 22 wherein said product is a laminate of said layers between said first and said second supports, the bond between a pair of predetermined layers being weaker than the bonds between the other layers, said rupturable container being so positioned as to release said processing composition for distribution between said pair of layers.

25. A photographic product as defined in claim 16 wherein said silver halide emulsions are present as separate planar layers.

26. A photographic product as defined in claim 16 wherein said silver halide emulsions are present in the form of minute elements arranged in side-by-side relationship in a photosensitive screen pattern.

27. A photographic product as defined in claim 1 wherein said blue-sensitive silver halide emulsion layer is between said image-receiving layer and said other silver halide emulsion layers.

28. A photographic product as defined in claim 1 wherein said blue-sensitive silver halide emulsion layer is between said first support and said other silver halide emulsion layers, and said first support is transparent.

29. A photographic product as defined in claim 28 wherein the outer surface of said transparent first support is a non-planar, embossed surface.

30. A photographic product as defined in claim 1 wherein said non-planar, embossed surface is a lenticular surface.

31. A photographic product as defined in claim 30 wherein said lenticular surface comprises at least 150 lenticules per inch.

32. A photographic product as defined in claim 30 wherein said lenticular surface comprises at least 250 lenticules per inch.

33. A photographic product as defined in claim 30 wherein said lenticules are convex.

34. A photographic product as defined in claim 30 wherein the maximum angle of each lenticule to the base plane thereof is less than about 15°.

35. A photographic product as defined in claim 30 wherein the maximum angle of each lenticule to the base plane thereof is about 10°.

36. A photographic product as defined in claim 30 wherein said lenticules are randomly arranged.

* * * * *

UNITED STATES PATENT AND TRADEMARK OFFICE

CERTIFICATE OF CORRECTION

PATENT NO. : 4,040,830

DATED : August 9, 1977

INVENTOR(S) : Howard G. Rogers

It is certified that error appears in the above-identified patent and that said Letters Patent are hereby corrected as shown below:

Column 2, line 31, "neegative" should be --negative--.

Column 5, line 6, "opacitying" should be --opacifying--.

Column 5, line 53, after "contained" insert --therein--.

Column 6, line 5, "to" should be --so--.

Column 9, line 46, "2,744,668" should be --2,774,668--.

Column 11, line 2, "3,647,4317" should be --3,647,437--.

Column 11, line 46, "group" should be --grouping--.

Column 12, line 18, after "control" change "the" to --or--.

Column 12, line 21, after "timing" insert --layers--.

Column 13, line 29, after "cellulose" insert --acetate--.

Column 14, line 7, "low" should be --lower--.

Column 14, line 50, "relfection" should be --reflection--.

UNITED STATES PATENT AND TRADEMARK OFFICE

CERTIFICATE OF CORRECTION

PATENT NO. : 4,040,830

DATED : August 9, 1977

INVENTOR(S) : Howard G. Rogers

It is certified that error appears in the above-identified patent and that said Letters Patent are hereby corrected as shown below:

Column 15, line 57, "releasable" should be --releasably--.

Column 16, line 59, after "acetate" insert --butyrate--.

Column 17, line 3, "releasable" should be --releasably--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*